US005633665A

United States Patent [19]

Komuro

[11] Patent Number: 5,633,665

[45] Date of Patent: May 27, 1997

[54] INK JET RECORDING METHOD AND APPARATUS

[75] Inventor: Hirokazu Komuro, Yokohama, Japan

[73] Assignee: Canon Kabushiki Kaisha, Tokyo, Japan

[21] Appl. No.: 559,252

[22] Filed: Nov. 15, 1995

Related U.S. Application Data

[63] Continuation of Ser. No. 77,031, Jun. 16, 1993, abandoned.

[30] Foreign Application Priority Data

Jun. 16, 1992 [JP] Japan ..... 4-156962

[51] Int. Cl.[6] ..... B41J 2/07

[52] U.S. Cl. ..... 347/63

[58] Field of Search ..... 347/63, 64, 65

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/140 R |
| 4,558,333 | 12/1985 | Sugitani et al. | 346/140 R |
| 4,719,478 | 1/1988 | Tachihara et al. | 346/140 R |
| 4,723,129 | 2/1988 | Endo et al. | 346/1.1 |
| 4,740,796 | 4/1988 | Endo et al. | 346/1.1 |
| 5,230,926 | 7/1993 | Narang et al. | 29/890.1 |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—Valerie Lund

*Attorney, Agent, or Firm*—Fitzpatrick, Cella, Harper & Scinto

[57] ABSTRACT

An ink jet recording method in which an ink jet recording is carried out using an ink jet recording head having a heat generating resistor layer for generating thermal energy, an electrode layer for supplying an electric signal to the heat generating resister layer to actuate it, a single silicon substrate having a width not less than 30 mm, on which the heat generating resistor layer and the electrode layer are formed, a liquid passage for supplying liquid to the heat generating resistor layer, and an ejection outlet for ejecting the liquid, the improvement residing in that a recording width of the substrate is not less than 30 mm;

$$W \times tp \times f \times k < 1.30$$

is satisfied, where W is electric energy (W) supplied to the heat generating resistor, tp is a driving pulse width (sec) and f is a driving frequency (Hz), and k is recording density (dots/mm).

2 Claims, 4 Drawing Sheets

INK JET RECORDING METHOD AND APPARATUS

This application is a continuation of application Ser. No. 08/077,031, filed Jun. 16, 1993, now abandoned.

FIELD OF THE INVENTION AND RELATED ART

The present invention relates to an ink Jet recording method and apparatus in which liquid is ejected or discharged through an ejection outlet using heat.

An example of such an ink jet recording method using heat is disclosed in U.S. Pat. No. 4,723,129.

In one of the recording methods disclosed therein, liquid supplied with thermal energy is super heated to produce a bubble, and the force produced by the bubble ejects droplets of liquid through an orifice onto a recording material.

A recording head imprementing the recording method comprises an orifice through which the liquid is ejected, a liquid passage communicating with the orifice for constituting a heat acting portion where the liquid receives the thermal energy, and an electrothermal transducer in the form of a heat generating resistor for producing the thermal energy, an electrode layer for applying an electric signal to said electrothermal transducer, and a substrate for supporting the electrothermal transducer and the electrode layer.

In a recording head using an ink jet recording method of this kind, a recording head having a large number of such electrothermal transducer and orifices are arranged over a range covering a width of the recording material. However, such a long recording head involves the problem of low yield, and therefore, a plurality of approx. 15 mm length units are arranged to cover the recording width. However, because of the recent demand for the high speed and high quality recording, the disturbance to the image due to the misalignment between the adjacent recording units. In order to avoid such disturbance, that is, in order to position the units relative to each other with high precision, the manufacturing cost has to be increased.

On the other hand, the manufacturing techniques have been recently improved to permit a longer unit or substrate can be produced with improved yield, and 200 mm or 300 mm length recording head is produced. However, when a solid (black) image is recorded by such a long or large recording width recording head (all nozzles are driven), it sometimes becomes difficult to stably print for a long period of time.

The investigations have been made as to the causes for this by the inventors, and it has been found that the productions of the bubbles become unsable after the long term operation in the conventional manner. It has further be found that this occurs frequently in the recording head having a recording width of not less than 30 mm.

As the instability of the bubble production, the temperature increase per in the order of second, of the substrate, is considered. The temperature rise of the substrate significantly depends on the recording width of the recording head, the recording density, the driving frequency, the driving pulse width and the electric energy supplied to the heater. The electric energy supplied to the heater is greatly related with the bubble generating energy, and therefore, is related to the film structure of the heater board.

Therefore, with the recording head having a recording width not less than 30 mm, these parameters are considered. On the other hand, in order to prevent temperature rise of the substrate, there is a method of using cooling fan or another external cooling means. However, such method would result in cost increase and apparatus size increase.

SUMMARY OF THE INVENTION

Accordingly, it is a principal object of the present invention to provide an ink jet recording or printing method and apparatus in which the ejection or discharge of the ink is stabilized.

It is another object of the present invention to provide such an apparatus and method in which the length of the recording means is more than 30 mm.

According to an aspect of the present invention, there is provided an ink jet recording method in which an ink jet recording is carried out using an ink jet recording head having a heat generating resistor layer for generating thermal energy, an electrode layer for supplying an electric signal to the heat generating resistor layer to actuate it, a substrate on which the heat generating resistor layer and the electrode layer are formed, a liquid passage for supplying liquid to the heat generating resistor layer, and an ejection outlet for ejecting the liquid, the improvement residing in that a recording width of the substrate is not less than 30 mm;

$$W \times tp \times f \times k < 1.30$$

is satisfied, where W is electric energy (W) supplied to the heat generating resistor, tp is a driving pulse width (sec) and f is a driving frequency (Hz), and k is recording density (dots/m).

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
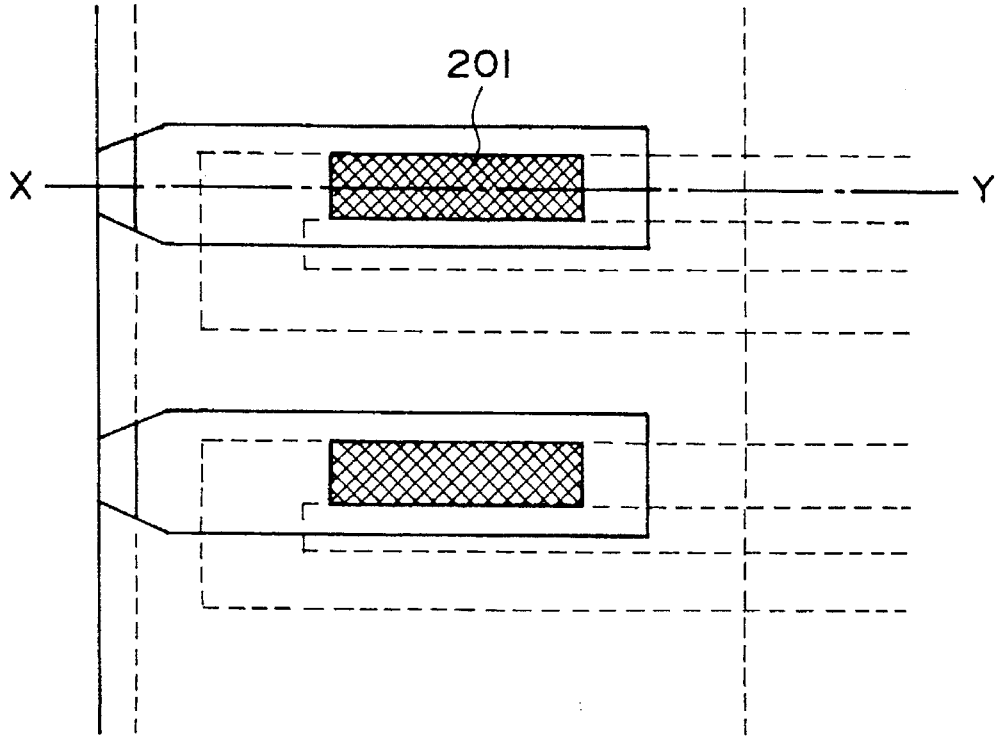
FIG. 1 is a top plan view of a heater board according to a first embodiment and a second embodiment of the present invention.
Figure 2:
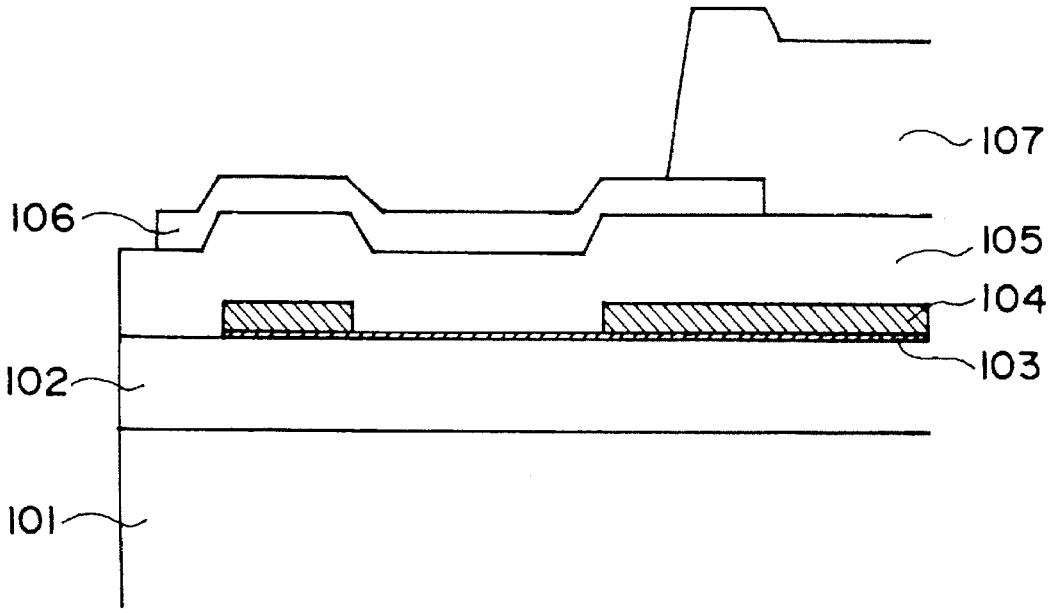
FIG. 2 is a sectional view taken along a line X—Y of FIG. 1.
Figure 3:
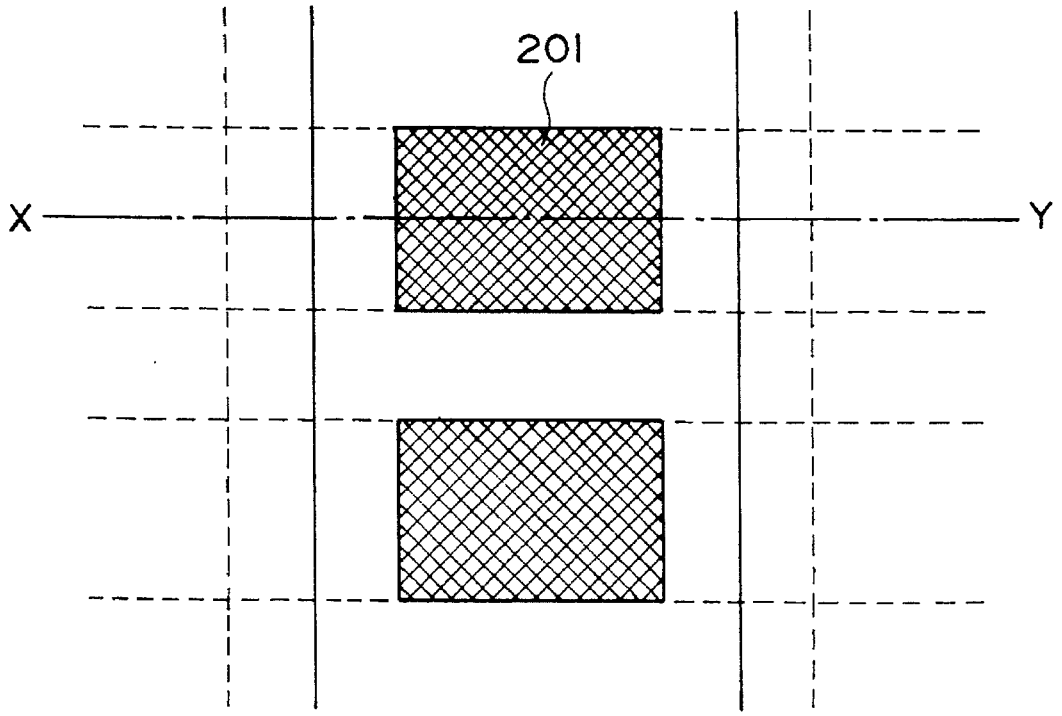
FIG. 3 is a top plan view of a heater board according to third and fourth embodiments of the present invention.
Figure 4:
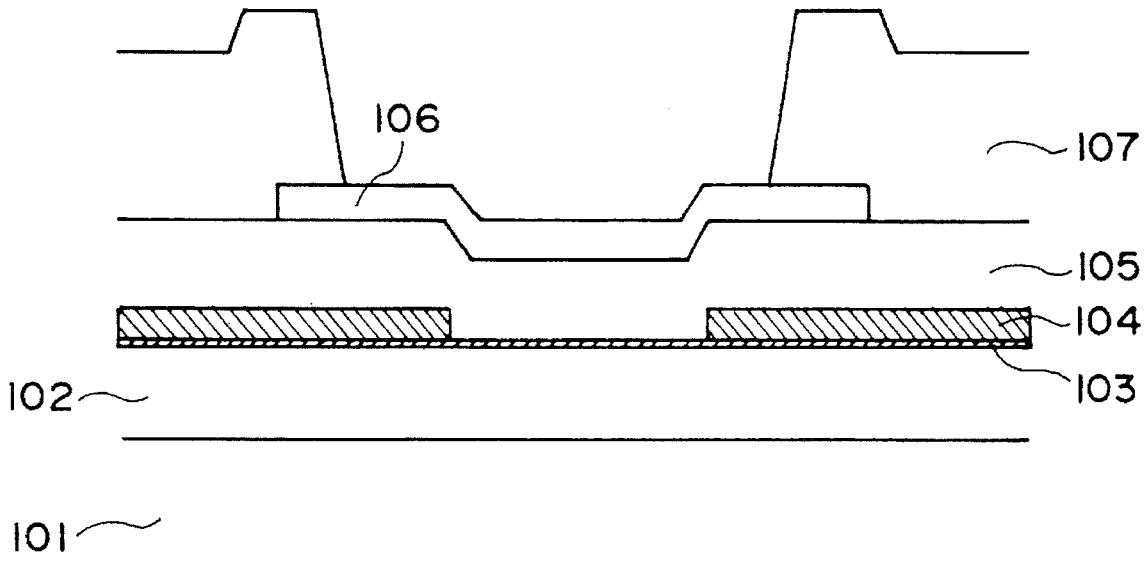
FIG. 4 is a sectional view taken along a line X—Y in FIG. 3.

Referring to FIGS. 1 and 2, a 0.3 micron-thick $SiO_2$ layer is formed by heat oxidation as a heat accumulating layer 102 on a substrate 101. Subsequently, 0.1 micron-thick $HfB_2$ is formed by sputtering as a heat generating resistor layer 103. The sheet resistance thereof was 20 ohm/□. Subsequently, 0.005 micron-thick Ti and 0.6 mm-thick Al are formed by evaporation as an electrode layer 104. Through photolithography, a circuit pattern of FIG. 1 (Embodiment 1 (Examples 1-2, 1-3) and Embodiment 2 (Examples 2-1, 2-2, 2-4)) and a circuit pattern of FIG. 3 (Embodiment 3 (Examples 3-2, 3-3, 3-5) and Embodiment 4 (Examples 4-1, 4-3, 4-4, 4-5)), are formed, and heaters 201 having sizes shown in Table 1 are formed at the recording density shown in the same Table. The effective widths of the recording heater are 15 mm, 30 mm, 50 mm, 100 mm and 200 mm, as shown in Table 2 for the respective embodiments. The resistance of the electrodes in the first and second embodiments, was 20 ohm, and that in the third and fourth embodiments, was 5 ohm. Subsequently, as a first protection layer 105, $SiO_2$ film is formed by a bias sputtering method with the thickness shown in Table 1. As a second protection layer 105, Ta film is formed by a sputtering method with the thickness of Table 1. Through the photolithographic process, bar patterns of FIG. 1 (Embodiments 1 and 2) and those of FIG. 3 (Embodiments 3 and 4), are formed. Finally, a third protection layer 107 is formed by applying photosensitive polyimide material into a pattern of FIG. 1 (Embodiments 1 and 2), or to the pattern of FIG. 3 (Embodiments 3 and 4). In this manner, the heater board is manufactured.

Figure 5:
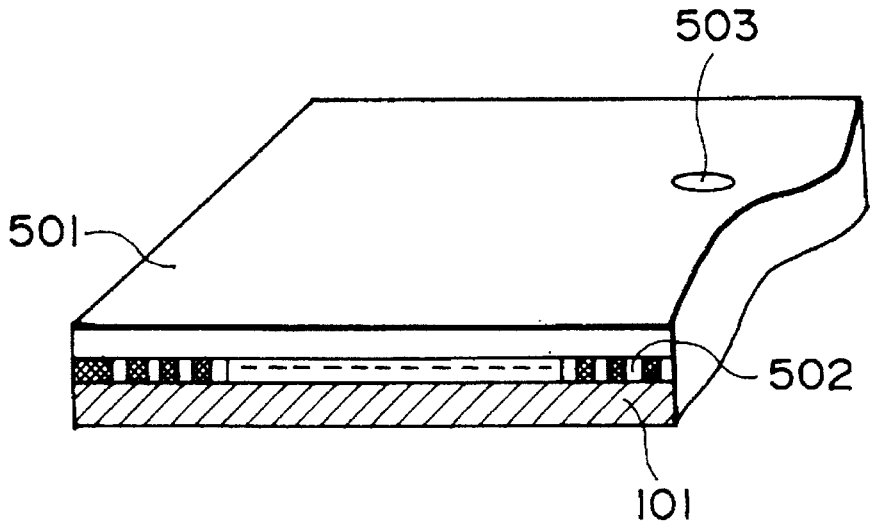
FIG. 5 is a perspective view of a recording head according to the first and second embodiments of the present invention.

In the embodiments 1 and 2, a nozzle wall is produced by a photosensitive resin material, and a plate having an ink chamber defining portion and ink supply port defining portion with supply port 503 is bonded thereon. By cutting properly it, ejection outlets 502 are provided. In Embodiment 1, the ejection outlet has a size of 20 micron×20 micron, and in Embodiment 2, the size is 20 micron×20 micron. With proper electric elements attached thereto, the recording head 501 shown in FIG. 5 is manufactured. With this recording head, the ink ejects in the detection along the surface of the heater.

Figure 6:
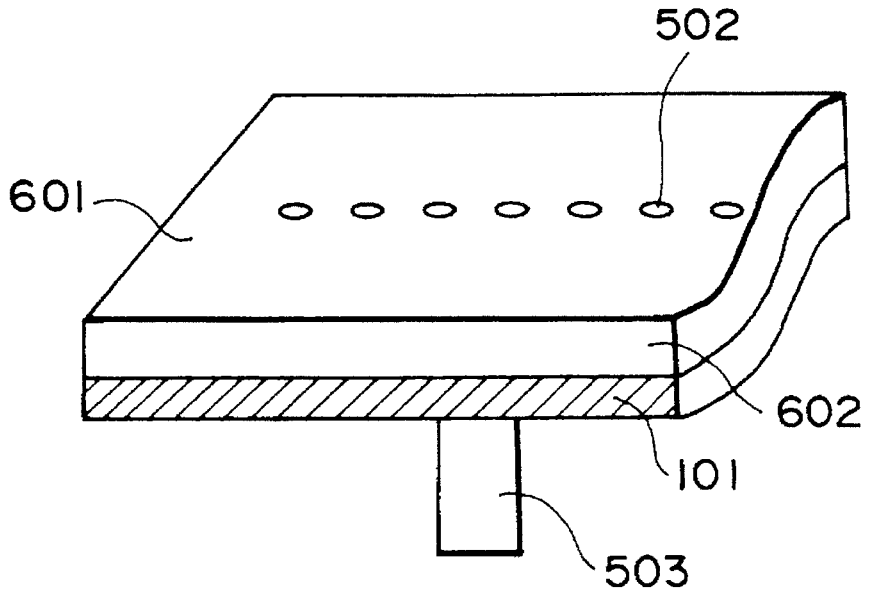
FIG. 6 is a perspective view of the recording heads according to third and fourth embodiments of the present invention.

The heater boards of Embodiments 3 and 4 group, is provided with a port for ink supply 503, and an orifice plate 602 having a portion for defining an ejection outlet 502 and ink chamber is bonded. In Embodiments 3, the ejection outlets have a size of 60 micron-diameter, and in Embodiments 4, they are 100 micron-diameter. With electric elements attached thereto, the recording head 601 shown in FIG. 6 is manufactured. With this recording or printing head, the ink is ejected in the direction perpendicular to the heater surface.

For the thus manufactured recording heads, the printing tests were carried out under various conditions. Bubble producing voltages are shown in Table 1. The driving conditions are shown in Table 1 regarding frequencies and pulse widths. The driving voltage was 1.15 times the bubble producing voltage as a minimum voltage capable of stable printing. If the driving voltage is increased, the electric energy supply to the heating portion is increased with the result of worse long term printing operation.

As for the method of evaluation, the printing durability is evaluated when all the ejection outlets are actuated. In Table 2, "N" means that the printing immediately becomes improper; "F" means that the printing becomes improper in one minute; and "G" means that proper printing continues for not less than one minute. The proper recording head is discriminated if the mark is "G". The driving conditions for the recording heads are calculated by the following:

$$W \times tp \times f \times k \quad (1)$$

where W is electric energy (W) supplied to the heater, tp is a driving pulse width (sec), f is a driving frequency (Hz), and k is a recording density (/mm).

The driving conditions are calculated by the equation (1), and the results are shown in Table 2.

For example, in Embodiment 1-1, the electric energy (W) is expressed by:

$$W = (\text{heater current}) \times (\text{heater current}) \times (\text{heater resistance}) = \{(\text{bubble producing voltage} \times 1.15)/\text{total resistance}\}^2 \times (\text{heater resistance})$$

Here, the heater sheet resistance is 20 ohm/□, and therefore, the heater resistance is 20×100μ/20μ=100 ohm.

The total resistance is expressed by the heater resistance plus electrode resistance, it is 100+20=120 ohm.

With these values, $$W = \{(13.1 \times 1.14)/120\}^2 \times 100 = 1.58$$

For the driving pulse width (tp)

$$tp = 100\ \mu\text{sec} = 10 \times 10^6\ \text{sec}$$

For the driving frequency (f)

$$f = 6\ \text{kHz} = 6 \times 10^3\ \text{Hz}$$

For the recording density (k)

$$k = 400\ \text{dots/inch} = 15.74/\text{mm}$$

From equation (1), $$W \times tp \times f \times k = 1.58 \times (10 \times 10^{-6}) \times (6 \times 10^3) \times 15.74 = 1.49$$

This is larger than 1.30.

As will be understood from FIG. 2, in the case of a recording head having a substrate with a length (recording width) not less than 30 mm, the printing durability during solid (black) image printing is satisfactory, if the driving condition expressed by the equation (1) is not more than 1.30. It is considered that if this is satisfied, the temperature increase of the substrate is suppressed within a desirable range when the recording head is driven. Therefore, it is preferable that when the ink jet head having the substrate with the recording width not less than 30 mm, the value obtained by the equation (1) is not more than 1.30. By doing so, the printing durability when solid (black) image is continuously formed.

TABLE 1

| | Heater size (μ) | Rec. Porosity (dpi) | Drive Frequency (kHz) | Drive pulse width (μsec) | $SiO_2$ film thickness (μ) | Ta film thickness (μ) | Bubble producing volt. (V) |
|---|---|---|---|---|---|---|---|
| Example 1-1 (Comparison Example) | 20 × 100 | 400 | 6 | 10 | 2.0 | 0.5 | 13.1 |
| Example 1-2 | 20 × 100 | 400 | 6 | 2 | 1.0 | 0.5 | 21.4 |
| Example 1-3 | 20 × 100 | 400 | 6 | 5 | 0.5 | 0.2 | 12.5 |
| Example 2-1 | 30 × 150 | 200 | 5 | 10 | 1.5 | 0.5 | 18.1 |
| Example 2-2 | 30 × 150 | 200 | 5 | 5 | 1.0 | 0.5 | 21.4 |
| Example 2-3 (Comp. Ex.) | 30 × 150 | 200 | 5 | 10 | 2.0 | 0.2 | 19.3 |
| Example 2-4 | 30 × 150 | 200 | 5 | 2 | 0.5 | 0.2 | 27.3 |
| Example 3-1 (Comp. Ex.) | 60 × 60 | 300 | 6 | 10 | 2.0 | 0.5 | 8.2 |
| Example 3-2 | 60 × 60 | 300 | 6 | 5 | 1.0 | 0.5 | 9.0 |
| Example 3-3 | 60 × 60 | 300 | 6 | 2 | 0.5 | 0.5 | 11.9 |
| Example 3-4 (Comp. Ex.) | 60 × 60 | 300 | 6 | 5 | 1.5 | 0.2 | 9.6 |
| Example 3-5 | 65 × 65 | 300 | 6 | 10 | 0.5 | 0.5 | 6.5 |
| Example 4-1 | 100 × 100 | 200 | 4 | 10 | 1.0 | 0.5 | 11.4 |
| Example 4-2 (Comp. Ex.) | 100 × 100 | 200 | 4 | 10 | 2.0 | 0.5 | 13.7 |
| Example 4-3 | 100 × 100 | 200 | 4 | 5 | 0.5 | 0.5 | 13.2 |
| Example 4-4 | 100 × 100 | 200 | 4 | 5 | 0.5 | 0.2 | 13.1 |
| Example 4-5 | 100 × 100 | 200 | 4 | 2 | 1.0 | 0.3 | 21.6 |

TABLE 2

| | | Continuation of solid image print | | | | |
|---|---|---|---|---|---|---|
| | Value of Eq. (1) | Rec. width 15 mm | Rec. width 30 mm | Rec. width 50 mm | Rec. width 100 mm | Rec. width 200 mm |
| Example 1-1 (Comparison Example) | 1.49 | G | F | F | F | N |
| Example 1-2 | 0.79 | G | G | G | G | G |
| Example 1-3 | 0.69 | G | G | G | G | G |
| Example 2-1 | 1.19 | G | G | G | G | G |
| Example 2-2 | 0.83 | G | G | G | G | G |
| Example 2-3 (Comp. Ex.) | 1.35 | G | F | F | F | F |
| Example 2-4 | 0.54 | G | G | G | G | G |
| Example 3-1 (Comp. Ex.) | 2.02 | G | N | N | N | N |
| Example 3-2 | 1.20 | G | G | G | G | G |
| Example 3-3 | 0.85 | G | G | G | G | G |
| Example 3-4 (Comp. Ex.) | 1.39 | G | F | F | F | F |
| Example 3-5 | 1.30 | G | G | G | G | G |
| Example 4-1 | 1.75 | G | F | N | N | N |
| Example 4-2 (Comp. Ex.) | 2.49 | G | N | N | N | N |
| Example 4-3 | 1.16 | G | G | G | G | G |
| Example 4-4 | 1.14 | G | G | G | G | G |
| Example 4-5 | 1.25 | G | G | G | G | G |

Figure 7:
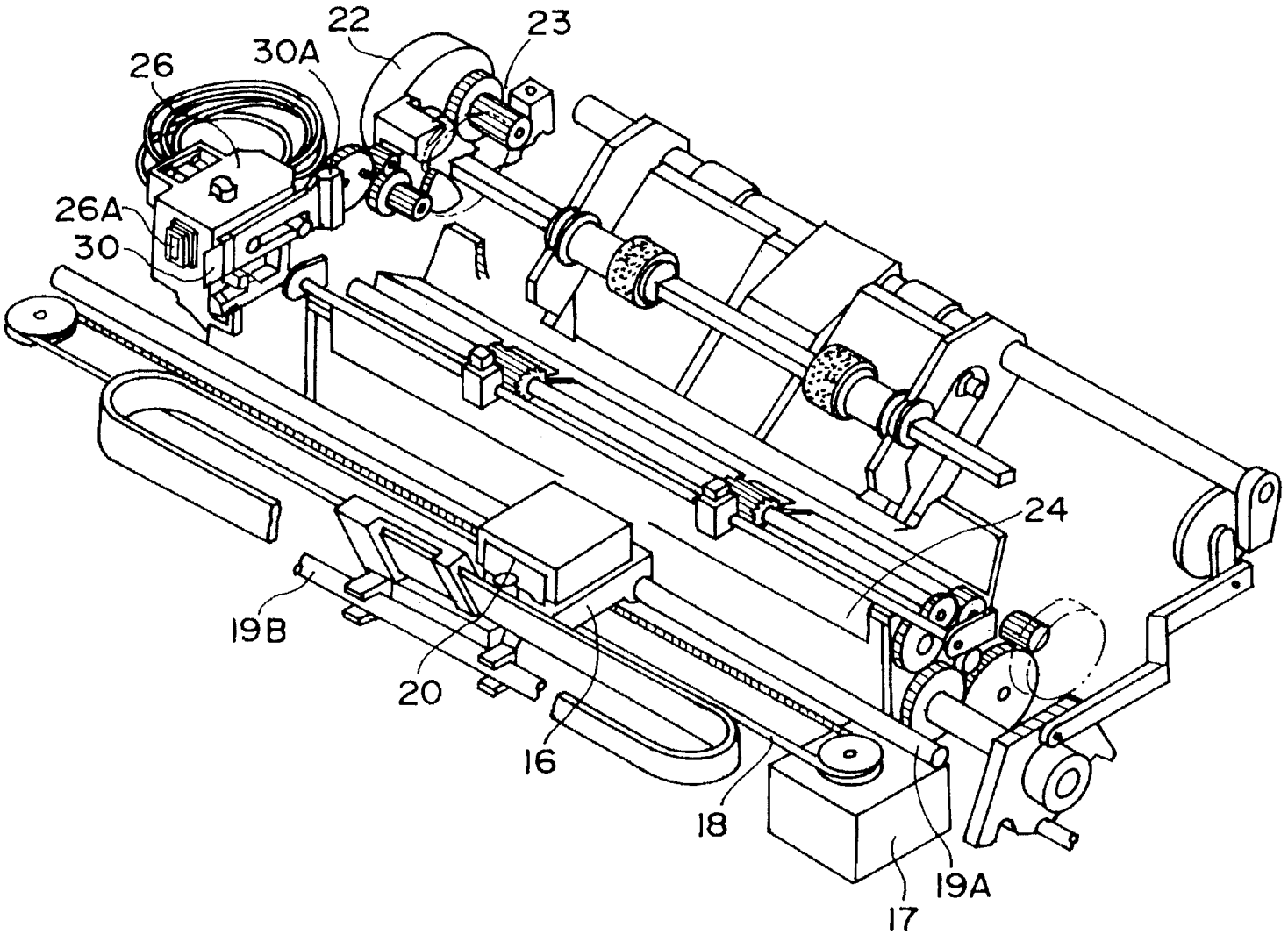
FIG. 7 is a perspective view of an example of a recording apparatus according to an embodiment of the present invention.

Referring to FIG. 7, an example of a recording apparatus according to the present invention will be described. As shown in Figure, an ink jet recording apparatus IJRA is loaded with an ink jet head cartridge IJC (recording head). The apparatus comprises driving signal supply means for supplying driving signals to the recording head, the driving signals satisfy the above-described condition.

The ink jet head cartridge 20 is provided with nozzles for ejecting the ink to the recording surface of the recording material supplied onto a platen 24. A carriage (HC) 16 functions to carrying the ink jet cartridge 20, and is connected with a driving belt 18 for transmitting driving force of a driving motor. It is slidably guided by two guiding shafts 19*a* and 19*b* which are disposed in parallel with each other to permit reciprocal motion covering the entire width of the recording sheet. A recovery device 26 is disposed at a position faced to an end of a movable stroke of the ink jet head cartridge 20, that is, a home position for example. By the driving force of a motor 22 through a transmission mechanism 23, the head recovery device 26 is operated, and the ink jet head cartridge 20 is capped. In association with the capping operation for the ink jet head cartridge 20 by the cap 26A of the head recovery device 26, the ink is sucked out by sucking means in the recording head recovery device 26, or the ink is pushed by pressure means provided at a proper position in an ink supply passage of the ink jet head cartridge 20, by which the ink is forcedly ejected through the ink ejection outlets, thus removing viscosity-increased ink in the nozzle, thus recovering the ejection outlet.

Upon completion of the recording operation, the capping is effected to protect the ink jet head cartridge 20.

A wiping member in the form of a blade 30 of silicone rubber is disposed at a side of the head recovery device 26. The blade 30 is supported on a blade supporting member 30A by canti-lever supporting structure. Similarly to the ink Jet head recovery device 26, it is operated by the motor 22 and through the transmission mechanism 23, and becomes engageable with the ejection side surface of the ink jet head cartridge 20. By doing so, the blade 30 is pushed into the moving path of the ink jet head cartridge 20 at proper timing during the recording operation of the ink jet head cartridge 20, or after the ejection recovery process of the head recovery device 26. By doing so, with the aid of the movement of the ink jet head cartridge 20, dew, wetting, foreign matter or the like is removed from the ejection side surface of the ink jet head cartridge 20.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

The recording method and apparatus of this invention is applicable to printing on cloth or the like. In order to improve the fixing of the ink on the close or the like, the printing apparatus incorporate pre-process or post-process means. Therefore, in the foregoing, "recording" includes recording on cloth paper or the like.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording method wherein an ink is ejected through a plurality of ejection outlets, comprising the steps of:

providing a recording head having a plurality of heat generating resistors for producing thermal energy for ejecting a liquid and a single silicon substrate having a width not less than 30 mm and having a plurality of electrodes for supplying electric signals for driving the heat generating resistors at a recording density k, where k is measured in dots per mm, and a plurality of ink passages in association with said heat generating resistors;

applying, through a given said electrode, to at least one said heat generating resistor, the drive signal satisfying the following relationship;

$$W \times tp \times f \times k < 1.30\ w \times sec/pulse \times pulse/sec \times dots/mm,$$

where W is supplied electric power measured in watts, tp is a width of a driving pulse in seconds per pulse, and f is a driving frequency measured in pulses per second.

2. A recording apparatus for performing ink jet recording, comprising:

an ink jet recording head having a plurality of heat generating resistors for producing thermal energy for ejecting a liquid and a single silicon substrate having a width not less than 30 mm and having a plurality of electrodes for supplying electric signals for driving the heat generating resistors at a recording density k, where k is measured in dots per mm, and a plurality of ink passages in association with said heat generating resistors; and applying means for applying a driving signal through a given said electrode, to at least one said heat generating resistor, the drive signal satisfying a following relationship;

$$W \times tp \times f \times k < 1.30\ w \times sec/pulse \times pulse/sec \times dots/mm,$$

where W is supplied electric power measured in watts, tp is a width of a driving pulse in seconds per pulse, and f is a driving frequency measured in pulses per second.

* * * * *

UNITED STATES PATENT AND TRADEMARK OFFICE

CERTIFICATE OF CORRECTION

PATENT NO. : 5,633,665

DATED : May 27, 1997

INVENTOR : HIROKAZU KOMURO

It is certified that error appears in the above-identified patent and that said Letters Patent is hereby corrected as shown below:

ON TITLE PAGE ITEM

[57] ABSTRACT LINE 5,

"resister" should read --resistor--.

COLUMN 1

Line 19, "imprementing" should read --implementing--;
Line 31, "transducer" should read --transducers--;
Line 37, "due" should read --is due--;
Line 44, "can be" should read --to be--;
Line 52, "unsable" should read --unstable--;
Line 53, "be" should read --been--.

COLUMN 2

Line 1, "cooling" should read --a cooling--;
Line 34, "m)." should read --mm).--.

UNITED STATES PATENT AND TRADEMARK OFFICE

CERTIFICATE OF CORRECTION

PATENT NO. : 5,633,665

DATED : May 27, 1997

INVENTOR : HIROKAZU KOMURO

It is certified that error appears in the above-identified patent and that said Letters Patent is hereby corrected as shown below:

COLUMN 3

Line 29, "properly it," should read --it properly,--;
Line 39, "ink" should read --an ink-- and "embodiments" should read --embodiment--;
Line 41, "ments" should read --ment--.

COLUMN 5

Line 56, "Figure," should read --the Figure--.

COLUMN 7

Line 7, "Jet" should read --jet--;
Line 40, "the" (first occurrence) should be deleted.

COLUMN 8

Line 29, "is" (first occurrence) should read --in--;

UNITED STATES PATENT AND TRADEMARK OFFICE

CERTIFICATE OF CORRECTION

PATENT NO. : 5,633,665

DATED : May 27, 1997

INVENTOR : HIROKAZU KOMURO

It is certified that error appears in the above-identified patent and that said Letters Patent is hereby corrected as shown below:

COLUMN 8 continued

Line 50, "computer" should read --a computer--;
Line 56, "incorporate" should read --incorporates--.

Signed and Sealed this

Sixth Day of January, 1998

*Attest:*

*Attesting Officer*

BRUCE LEHMAN

*Commissioner of Patents and Trademarks*